US006747670B2

(12) United States Patent
Doyen et al.

(10) Patent No.: US 6,747,670 B2
(45) Date of Patent: Jun. 8, 2004

(54) METHOD OF ADDRESSING A PLASMA DISPLAY PANEL

(75) Inventors: Didier Doyen, La Bouexière (FR); Jonathan Kervec, Gévezé (FR)

(73) Assignee: Thomson Licensing S.A., Boulogne Cedex (FR)

( * ) Notice: Subject to any disclaimer, the term of this patent is extended or adjusted under 35 U.S.C. 154(b) by 345 days.

(21) Appl. No.: 09/737,076

(22) Filed: Dec. 14, 2000

(65) Prior Publication Data

US 2001/0005191 A1 Jun. 28, 2001

(30) Foreign Application Priority Data

Dec. 22, 1999 (FR) ..... 99 16198

(51) Int. Cl.[7] ..... G09G 5/10

(52) U.S. Cl. ..... 345/690; 345/63; 315/169.4; 348/797

(58) Field of Search ..... 345/63, 60, 99, 345/72, 208, 690, 89, 94, 67, 77, 79, 84, 204; 315/169.4, 169.1–169.3; 348/797

(56) References Cited

U.S. PATENT DOCUMENTS 5,172,107 A * 12/1992 Kanno et al. ..... 345/100
5,357,267 A * 10/1994 Inoue ..... 345/531
5,477,235 A * 12/1995 Numao ..... 345/97
5,726,677 A * 3/1998 Imamura ..... 345/99
5,754,160 A * 5/1998 Shimizu et al. ..... 345/103
6,014,121 A * 1/2000 Aratani et al. ..... 345/89

FOREIGN PATENT DOCUMENTS

EP 0874348 A1 10/1998 ..... G09G/3/28
EP 0945846 A1 9/1999 ..... G09G/3/28

* cited by examiner

*Primary Examiner*—Bipin Shalwala
*Assistant Examiner*—Ricardo Osorio
(74) *Attorney, Agent, or Firm*—Joseph S. Tripoli; Ronald H. Kurdyla; Vincent E. Duffy

(57) ABSTRACT

The object of the invention is to provide a system for encoding grey levels which makes it possible to reduce the problems of contouring by increasing the number of sub-scans using subscans common to several rows, thereby remedying the error due to the difference between the grey levels of simultaneously scanned cells. The invention provides a method and a device which make row groupings dynamically according to the content of the image.

11 Claims, 6 Drawing Sheets

METHOD OF ADDRESSING A PLASMA DISPLAY PANEL

BACKGROUND OF THE INVENTION

1. Field of the Invention

The invention relates to a method of addressing a plasma display panel. More particularly, the invention relates to the coding of the grey levels of a type of panel with separate addressing and sustaining.

2. Discussion of Prior Art

Plasma display panels, called hereafter PDPs, are flat-type display screens. There are two large families of PDPs, namely PDPs whose operation is of the DC type and those whose operation is of the AC type. In general, PDPs comprise two insulating tiles (or substrates), each carrying one or more arrays of electrodes and defining between them a space filled with gas. The tiles are joined together so as to define intersections between the electrodes of the said arrays. Each electrode intersection defines an elementary cell to which a gas space corresponds, which gas space is partially bounded by barriers and in which an electrical discharge occurs when the cell is activated. The electrical discharge causes an emission of UV rays in the elementary cell and phosphors deposited on the walls of the cell convert the UV rays into visible light.

In the case of AC-type PDPs, there are two types of cell architecture, one called a matrix architecture and the other called a coplanar architecture. Although these structures are different, the operation of an elementary cell is substantially the same. Each cell may be in the ignited or "on" state or in the extinguished or "off" state. A cell may be maintained in one of these states by sending a succession of pulses, called sustain pulses, throughout the duration over which it is desired to maintain this state. A cell is turned on, or addressed, by sending a larger pulse, usually called an address pulse. A cell is turned off, or erased, by nullifying the charges within the cell using a damped discharge. To obtain various grey levels, use is made of the eye's integration phenomenon by modulating the durations of the on and off states using subscans, or subframes, over the duration of display of an image.

In order to be able to achieve temporal ignition modulation of each elementary cell, two so-called "addressing modes" are mainly used. A first addressing mode, called "Addressing While Displaying" (AWD), consists in addressing each row of cells while sustaining the other rows of cells, the addressing taking place row by row in a shifted manner. A second addressing mode, called "Addressing and Display Separation" (ADS), consists in addressing, sustaining and erasing all of the cells of the panel during three separate periods. For more details concerning these two addressing modes, a person skilled in the art may, for example, refer to U.S. Pat. Nos. 5,420,602 and/or 5,446,344.

FIG. 1 shows the basic time division of the ADS mode for displaying an image. The total display time Ttot of the image is 16.6 or 20 ms, depending on the country. During the display time, eight subscans SB1 to SB8 are effected so as to allow 256 grey levels per cell, each subscan making it possible for an elementary cell to be "on" or "off" for an illumination time Tec which is a multiple of a value To. Hereafter, reference will be made to an illumination weight p, where p corresponds to an integer such that Tec=p.To. The total duration of a subscan comprises an erasure time Tef, an address time Ta and the illumination time Tec specific to each subscan. The address time Ta can also be decomposed into n times an elementary time Tae, which corresponds to the addressing of one row. Since the sum of the illumination times Tec needed for a maximum grey level is equal to the maximum illumination time Tmax, we have the following equation: Ttot=m.(Tef+n.Tae)+Tmax, in which m represents the number of subscans. FIG. 1 corresponds to a binary decomposition of the illumination time.

One problem is the creation of false contouring which stems from the proximity of two areas whose grey levels are very close but whose illumination times are decorrelated. The worst case, in the example in FIG. 1, corresponds to a transition between the levels 127 and 128. This is because the grey level 127 corresponds to an illumination for the first seven subscans SB1 to SB7, while the level 128 corresponds to the illumination of the eighth subscan SB8. Two areas of the screen placed one beside the other, having the levels 127 and 128, are never illuminated at the same time. When the image is static and the observer's eyes do not move over the screen, temporal integration takes place relatively well (if any flicker effect is ignored) and two areas with relatively close grey levels are seen. On the other hand, when the two areas move over the screen (or the observer's eyes move), the integration time slot changes screen area and is shifted from one area to another for a certain number of cells. The shift in the eye's integration time slot from an area of level 127 to an area of level 128 has the effect of integrating so that the cells are off over the period of one frame, which results in the appearance of a dark contour of the area. Conversely, shifting the eye's integration time slot from an area of level 128 to an area of level 127 has the effect of integrating so that the cells are lit to the maximum over the duration of one frame, which results in the appearance of a light contour of the area (which is less perceptible than the dark contour). This phenomenon is accentuated when the display works with pixels consisting of three (red, green and blue) elementary cells, since the contouring may be coloured.

The phenomenon of contouring occurs at all level transitions where the switched illumination weights correspond to different temporal distribution groups. Switchings of high weight are more annoying than switchings of low weight because of their magnitude. The resulting effect may be perceptible to a greater or lesser extent depending on the switched weights and on their positions. Thus, the contouring effect may also occur with levels that are quite far apart (for example 63–128, but it is much less shocking for the eye as it then corresponds to a very visible level (or colour) transition.

To remedy the problem of contouring, one solution consists in breaking up the high illumination weights so as to reduce the visual effects of the high-weight transitions. FIG. 2 shows a solution in which 10 subscans are used, thereby resulting in an overall reduction in brightness of the panel. The maximum illumination time Tmax is then approximately 30% of the total image display time and the erasure and address time is about 70%.

The use of 10 subscans, as shown in FIG. 2, does not allow there to be perfect correction of the false contouring effect and requires an increase in the number of subscans. However, increasing the number of subscans creates a brightness-reduction problem.

In order to elevate this brightness reduction, it is known to use subscans common to two rows of the panel, thereby allowing the total number of subscans to be increased without reducing the actual image display time. FIG. 3 shows a distribution over 11 subscans, the low-weight subscans (weights 1 and 2) of which are common to two rows. The use of subscans common to two rows has the effect of dividing the address time of these subscans by two. The use of two common subscans makes it possible to use an additional subscan while maintaining a constant overall address time. But this creates a loss-of-resolution problem with the low weights.

To remedy the loss of resolution and to increase the number of common subscans, one solution consists in using a code with multiple representations. FIG. 4 shows a 12-subscan distribution, 4 of which are common to two adjacent rows. The multiple representation is based on the fact that there are several ways of coding a grey level. The coding of two adjacent grey levels is accomplished by using the coding which minimizes the error as far as possible. However, if the number of common subscans is increased, there is still a loss of resolution.

European Application EP-A-0 945 846 has disclosed a coding system which minimizes the error due to the simultaneous scanning of several pairs of rows with the aid of a code with multiple representation. FIG. 5 shows an example of coding over 14 subscans, the display time of which corresponds to about 10 subscans. In the example in FIG. 5, eight subscans of weight 1, 2, 4, 7, 13, 17, 25 and 36 are common to two rows at the same time, six subscans of weight 5, 10, 20, 30, 40 and 45 being specific to each row. The resolution error is minimized by rounding the difference between two adjacent grey levels so that the error is always equal to ±1.

The coding in FIG. 5 may appear ideal since the number of common subscans is very high. However, the use of many common subscans results in a coding difference error. In the example in FIG. 5, the sum of the weights associated with the subscans specific to each row is equal to 150. This means that when two adjacent cells are addressed simultaneously and the difference between the grey levels is greater than 150, an error then arises during display, which occurs on average on 1% of the dots of a video image.

SUMMARY OF THE INVENTION

The object of the invention is to propose a system for encoding grey levels which makes it possible to reduce the problems of contouring by increasing the number of subscans using subscans common to several rows, thereby remedying the error due to the difference between the grey levels of simultaneously scanned cells.

The invention is a method for displaying a video image on a display device comprising a plurality of cells in which each cell is illuminated for an illumination time by means of a plurality of subscans each having a specific duration associated with an illumination weight. The subscans are distributed as first and second subscans. The first subscans are addressed for each row of the panel. The second subscans are addressed simultaneously at row groupings having a number of rows which varies according to the image displayed.

To obtain the highest image quality, several possible ways of grouping the rows are evaluated and then the grouping which minimizes the display errors is chosen.

To reduce the address time, several possible ways of grouping the rows are evaluated and then the possible grouping which has the most rows is chosen.

To minimize the rounding errors in such a method, the illumination weights associated with the first subscans are multiples of three.

The invention also relates to a display device comprising a plurality of cells organized in rows and columns, each cell being illuminated over a display period for a time proportional to a grey level by means of a plurality of subscans, each subscan having an address time during which the rows are addressed in succession, characterized in that it includes means for addressing the rows by row grouping, the number of rows of which varies according to the image to be displayed.

More particularly, the display device is a plasma display panel comprising a plurality of discharge cells.

BRIEF DESCRIPTION OF THE DRAWINGS

The invention will be more clearly understood and further features and advantages will emerge on reading the description which follows, this being given with reference to the appended drawings in which.

DESCRIPTION OF THE PREFERRED EMBODIMENTS

For representational reasons, the temporal distribution of the subscans, which is shown in FIGS. 1 to 6, uses significant proportions which do not correspond to an exact linear scale.

Figure 6:
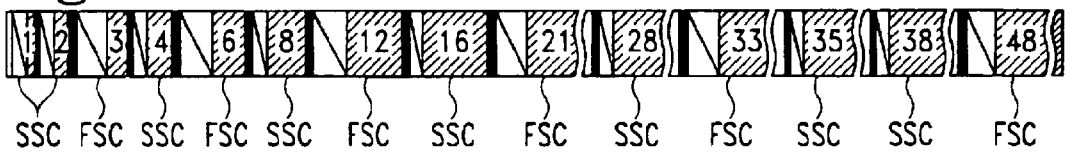
FIG. 6 shows a temporal distribution according to the invention.

FIG. 6 shows a preferred temporal distribution according to the invention. This temporal distribution comprises first subscans FSC specific to each row, which make it possible to address each cell of the screen individually. In the preferred example, six first subscans FSC are used, to which the respective illumination weights 3, 6, 12, 21, 33 and 48 are associated. Such a choice makes it possible to have a maximum difference value of 123 over 255 grey levels. Second subscans SSC make it possible to address the rows by row group. There are eight second subscans SSC with the respective weights 1, 2, 4, 8, 16, 28, 35 and 38.

Figure 7:
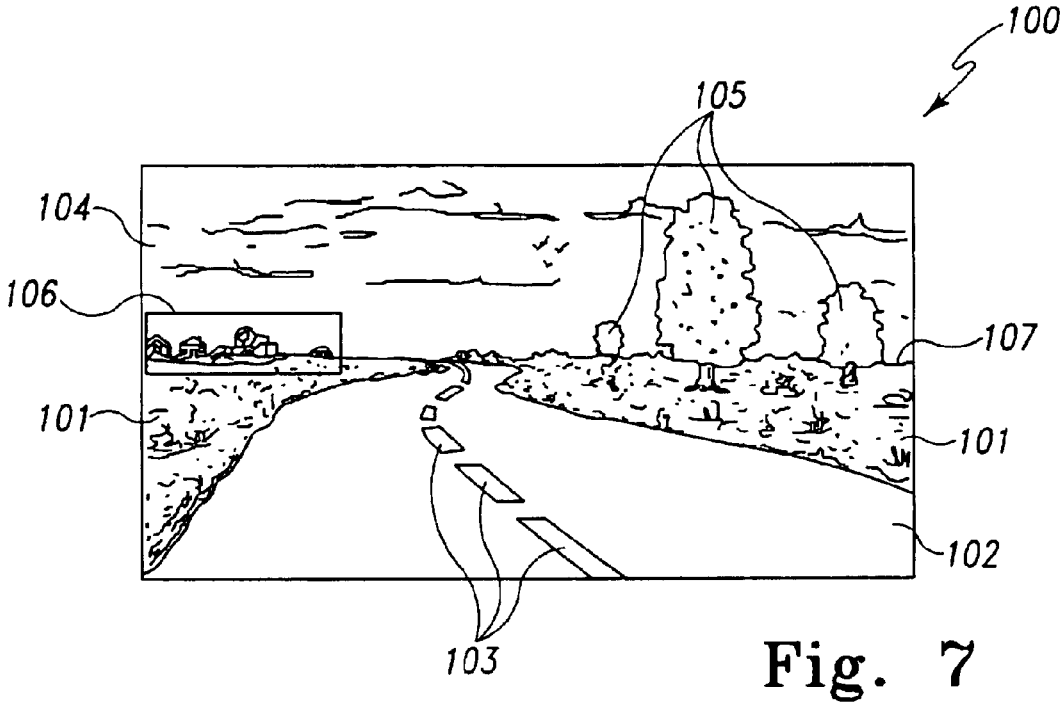
FIG. 7 shows an image to be displayed.
Figure 8:
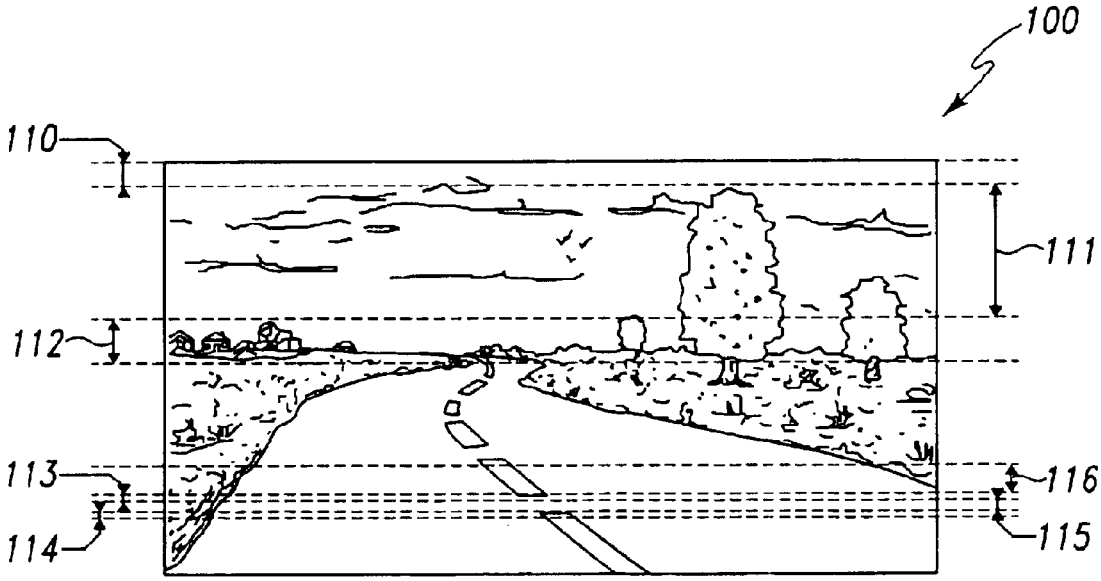
FIG. 8 shows the same image, revealing the break-down of the scan used, according to the invention.

Before explaining how to code the subscans, it is appropriate to explain the principle employed with the aid of FIGS. 7 and 8, which show the same image 100 corresponding to a conventional video image.

The image 100 is, for example, a scene which shows dark green fields through which passes a grey anthracite road 102 having a broken white line 103. The upper part of the image is a light blue sky 104 cut by trees 105. A group of houses 106 is on the horizon 107.

Figure 1:
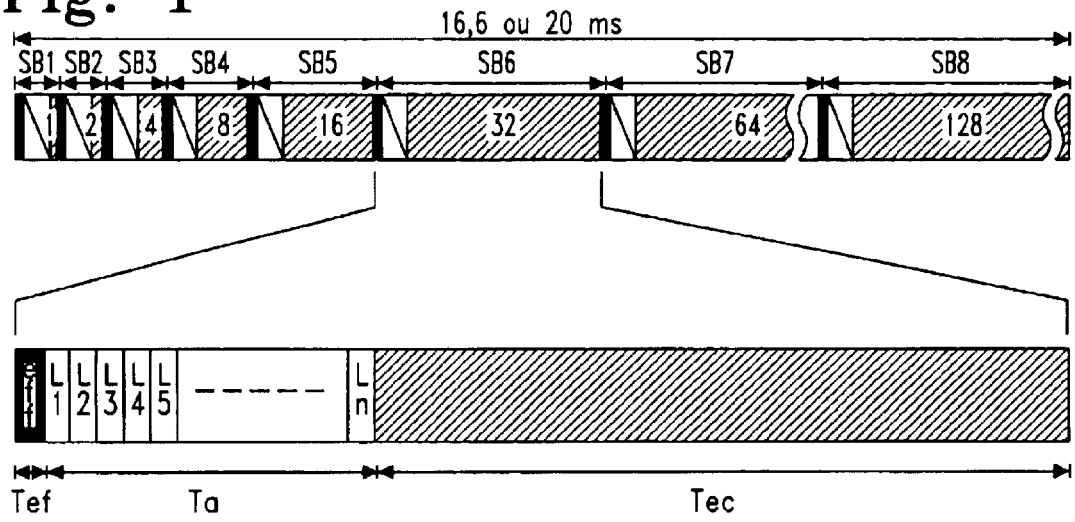
FIGS. 1 to 5 show temporal cell illumination distributions according to the prior art.
Figure 2:
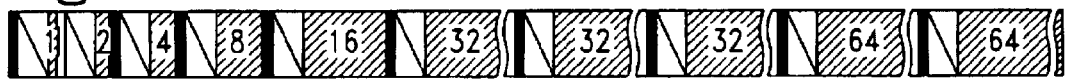
Figure 3:
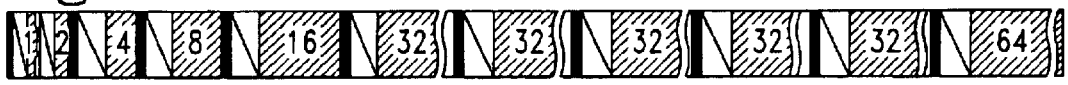
Figure 4:
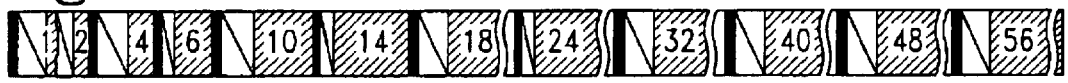
Figure 5:
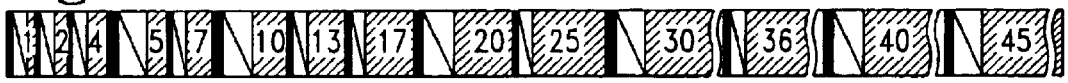

If the image 100 is coded according to a known technique, by addressing two simultaneous rows corresponding, for example, to the temporal distribution in FIG. 5, about 1% of the image dots have an error due to the maximum difference between the simultaneously addressed dots. Depending on the type of image, the error rate may vary between 0 and 5%. The distribution of the illumination weights also affects the error rate. The example in FIG. 5 allows a maximum difference of 150 between the grey levels of the cells addressed simultaneously. If this maximum difference is reduced, for example to 100, it may be seen that the error rate is barely increased, between 1 and 2% depending on the images. On the other hand, if this maximum difference is increased in order to reduce the error rate significantly, part of the benefit provided by the simultaneous addressing is then lost.

A more detailed analysis of the image shows that the errors due to the maximum difference are mainly localized at highly contrasted points on the image, but only when these are horizontal or almost horizontal lines. In the case of the image 100, coded with a maximum difference of 150, the errors are, on the one hand, highly localized in the region of the group of houses 106 and at the horizontal transitions between the road 102 and the broken lines 103 and, on the other hand, distributed sparsely along the horizon 107, over the profile of the trees 105, along the border between the road 102 and the broken lines 103, (when the transition is not horizontal) and between the road 102 and the fields 101. If the maximum difference is decreased, it will be noticed that the errors intensify but remain localized at the same positions. If the maximum difference decreases greatly, then new error areas appear.

If the errors are seen as rows of errors, then various areas can be identified. An area 110 located right at the top of the screen corresponds to error-free rows which exhibit little difference between the adjacent grey levels since the colours are almost the same. An area 111 located below the area 110 has a few (1 to 3) errors on a few pairs of rows. An area 112 has many errors. The whole image may be broken down in this way. As a non-limiting example, mention may be made of the areas 113 and 114 with a high error rate, the error-free area 115 and the area 116 having a low error rate.

The principle employed by the invention will use these error distribution properties to carry out addressing by large row group when the error rate is low so as to be able to address row by row when the error rate is high. This is because the error-free rows, for example the area 110, has dots of very similar colour, each component (red, green and blue) of which sees its grey level vary by at most 50 within the entire area 110. It would be possible to address all the rows of this area 110 simultaneously without having the slightest error and the saving in address time may then be transferred to an area 112 having a high error rate, which would be addressed row by row.

The implementation of the invention will be more clearly understood with the aid of the algorithms describing the overall principle of the invention. The algorithm in FIG. 9 comprises a first step 201 which serves to evaluate, per row group, for example per eight-row groups, which one-/two-/four- or eight-row groupings are possible. The evaluation, for all the groups of the image, may be carried out simultaneously or in succession for each group, depending on the choice of those skilled in the art. At the end of the first step, there is a plan for the optimized coding of the image per row group. The first step 201 will be explained in detail below with the aid of FIG. 10.

During a second step 202, the address time needed for the optimized coding of the image is computed. This may be limited to a relative time computation, that is to say a computation of the number of addressing operations to be carried out.

A test 203 compares the computed address time with the maximum permitted address time TMAX which is, for example, equal to the address time needed for a common scan of two successive rows. If the address time is less than or equal to the time TMAX, then the encoding takes place according to the optimized coding plan during a third step 204. If the address time is greater than the time TMAX, then encoding is carried out per two-row group during a fourth step 205.

As a variant, it is possible to carry out, instead of the fourth step 205, a fifth step 206 whose purpose is to reduce the optimum coding constraints and then to restart the algorithm at step 1. This solution has as major drawback a very long computation time which at the present time does not allow satisfactory implementation.

Figure 10:
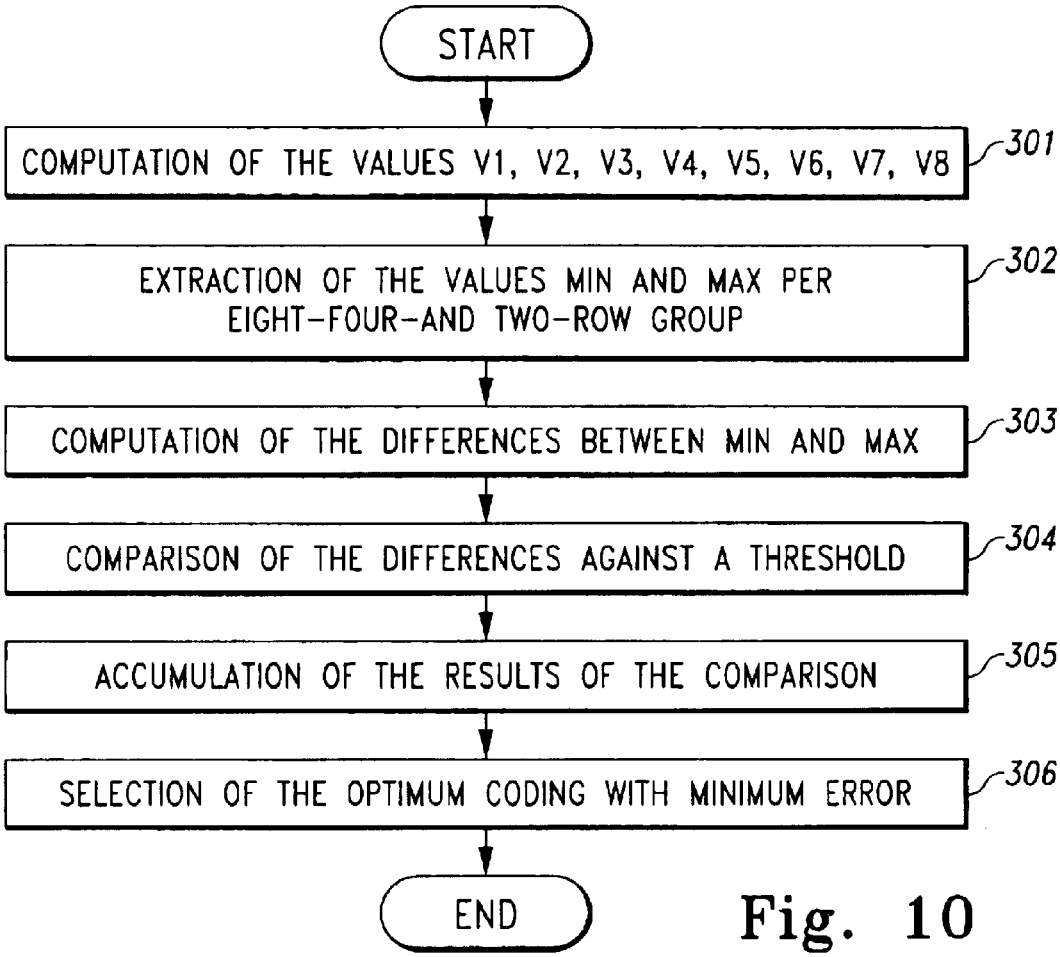

FIG. 10 shows the succession of steps employed for evaluating the coding of an eight-row group according to various possible groupings.

As may be seen in FIG. 6, the coding adopted allows only values which are multiples of 3 to be encoded, which fatally entails an encoding error. During a first step 301, a rounding of the values of the whole row is carried out so as to minimize the encoding error, whatever the coding grouping adopted. The rounding is done on the eight grey levels GL1 to GL8 corresponding to the same column. The preferred solution consists in taking the modulo-3 of all the grey levels. Then, the modulo-3, 0, 1 or 2, most used is determined. The grey levels corresponding to the modulo-3 most used remain unchanged, the value 1 being added to or subtracted from the other grey levels so that their modulo-3 becomes equal to the modulo most used. The operation thus carried out converts the grey levels GL1 to GL8 into values V1 to V8, the difference between which are always multiples of 3.

A second step 302 then extracts the maximum and minimum values from all the possible groups. The possible groups are the pairs consisting of the values V1 and V2, V3 and V4, V5 and V6, and V7 and V8, the quartets (or quadruplets) V1 to V4 and V5 to V8 and the octet (or octuplet) V1 to V8.

In a step 303, the difference between the minimum value and the maximum value is computed for each group. The differences are then compared, during a step 304, with a threshold S which corresponds to the maximum difference permitted by the temporal distribution chosen, S being, for example, equal to 123 if the temporal distribution in FIG. 6 is used.

The results of the comparison are accumulated in step 305. The accumulation takes place over the entire length of the rows. The accumulation makes it possible to evaluate several possible ways of grouping rows by counting the number of errors in each grouping. The number of errors counted corresponds to the number of columns which have at least one error for the given row grouping.

In step 306, the coding is chosen according to the accumulation of the results. The maximum optimization consists in retaining only the possibilities of a largest sized group, which make it possible to have no error over the entire length of the row. The constraint consisting in having no error cannot be achieved on all the images since the scan time would be much longer than the desired scan time. If errors on the groupings comprising more than two rows are accepted, the visual effect may be very undesirable. On the other hand, if a few errors, for example one or two errors, per two-row grouping is permitted, the image is improved over addressing by two-row groups, while allowing almost complete coding of the video images.

Figure 9:
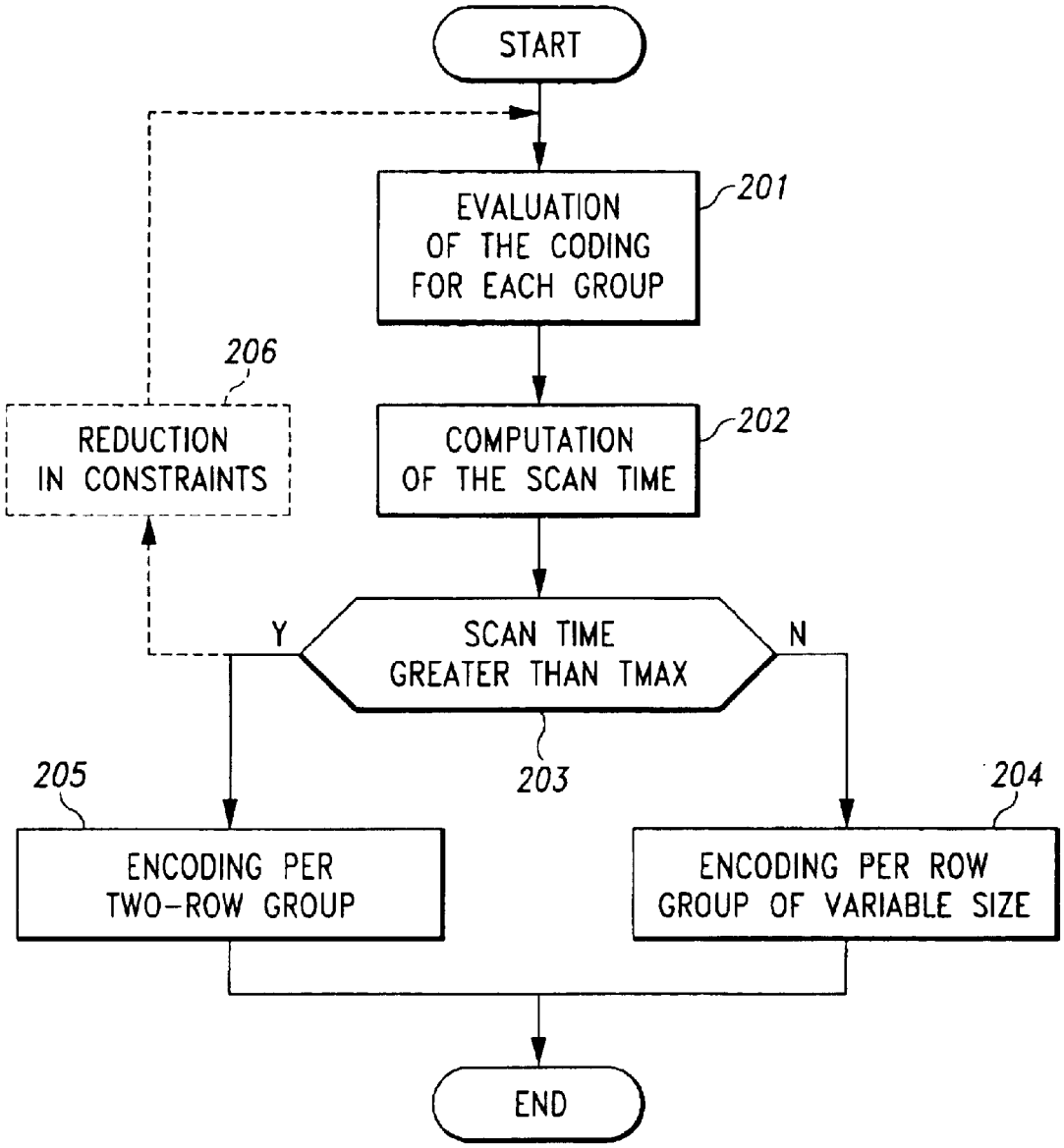
FIGS. 9 and 10 show the algorithms employed in the invention.

If a constraint reduction step is used in the flow chart in FIG. 9, the reduction in constraints corresponds to increasing the number of errors permitted per two-row group.

With regard to the choice of groupings, several possibilities are conceivable. In the rest of the description, two examples of groupings will be presented by way of indication.

Figure 11:
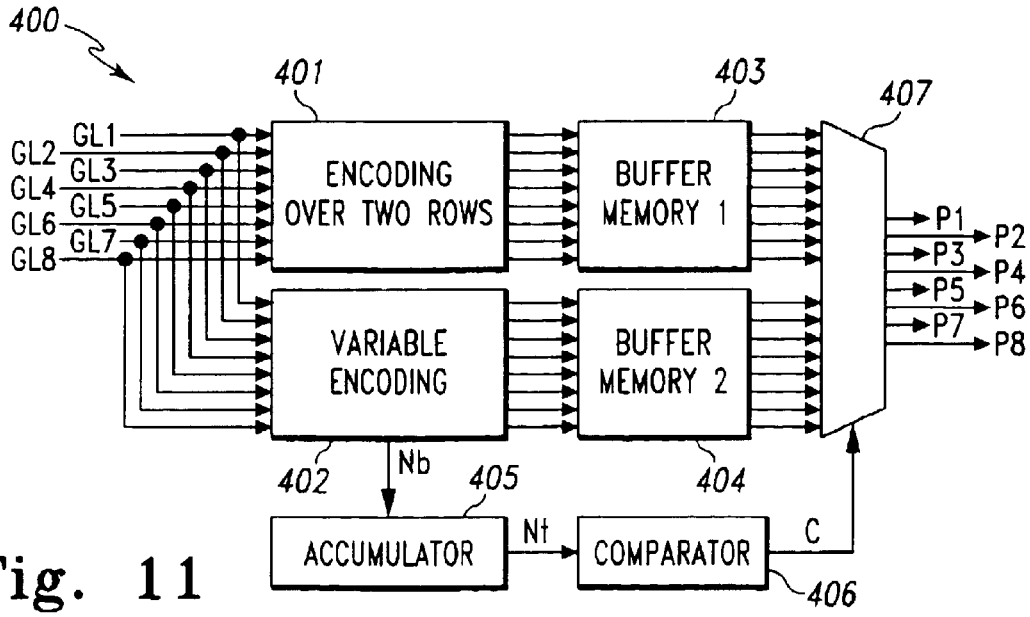
FIGS. 11 to 13 show examples of the encoding circuit for implementing the invention.

FIG. 11 shows an illustrative example of a circuit 400 according to the invention. For reasons of computation time, the evaluation of each group takes place simultaneously with the encoding of each group, the choice of coding to be used being made after the encoding.

The circuit 400 includes a circuit 401 for encoding over two rows and a circuit 402 for encoding over a grouping of variable size, which circuits each receive eight grey levels GL1 to GL8 in parallel, the grey levels GL1 to GL8 corresponding to the cells placed at the intersection of a column electrode with eight adjacent rows. The circuit 401 for encoding over two rows delivers, as output, eight words corresponding to the subscans which are or are not to be carried out in order to display the grey levels GL1 to GL8.

The circuit 402 for encoding over groupings of variable size delivers, on eight outputs, the eight words corresponding to the subscans which are or are not to be carried out in order to display the grey levels GL1 to GL8 and, on one output, an information item Nb representative of the number of row groupings made for the eight-row group processed.

The circuit 400 includes two delay circuits 403 and 404 which are connected to the outputs of the two encoding circuits 401 and 402. These delay circuits 403 and 404 consist, for example, of buffer memories of the FIFO type and allow a complete image to be stored so that it is possible to store the result of the coding until it is decided which coding will finally be chosen.

An accumulator circuit 405 receives, on one input, the information item Nb representative of the number of row groupings made for the eight-row group processed. The accumulator circuit 405 adds the information items Nb corresponding to all the eight-row groups of an image in order to be able to deliver, on an output and for each image, the total number Nt of groupings made.

A comparator circuit 406 receives the total number Nt so as to compare it with a threshold and to deliver a selected bit C to a multiplexer 407. If the number of groupings is greater than half the number of rows of the plasma panel, the eight words P1 to P8 being output by the multiplexer 407 correspond to the coding per two-row group, otherwise they correspond to the variable coding.

Figure 12:
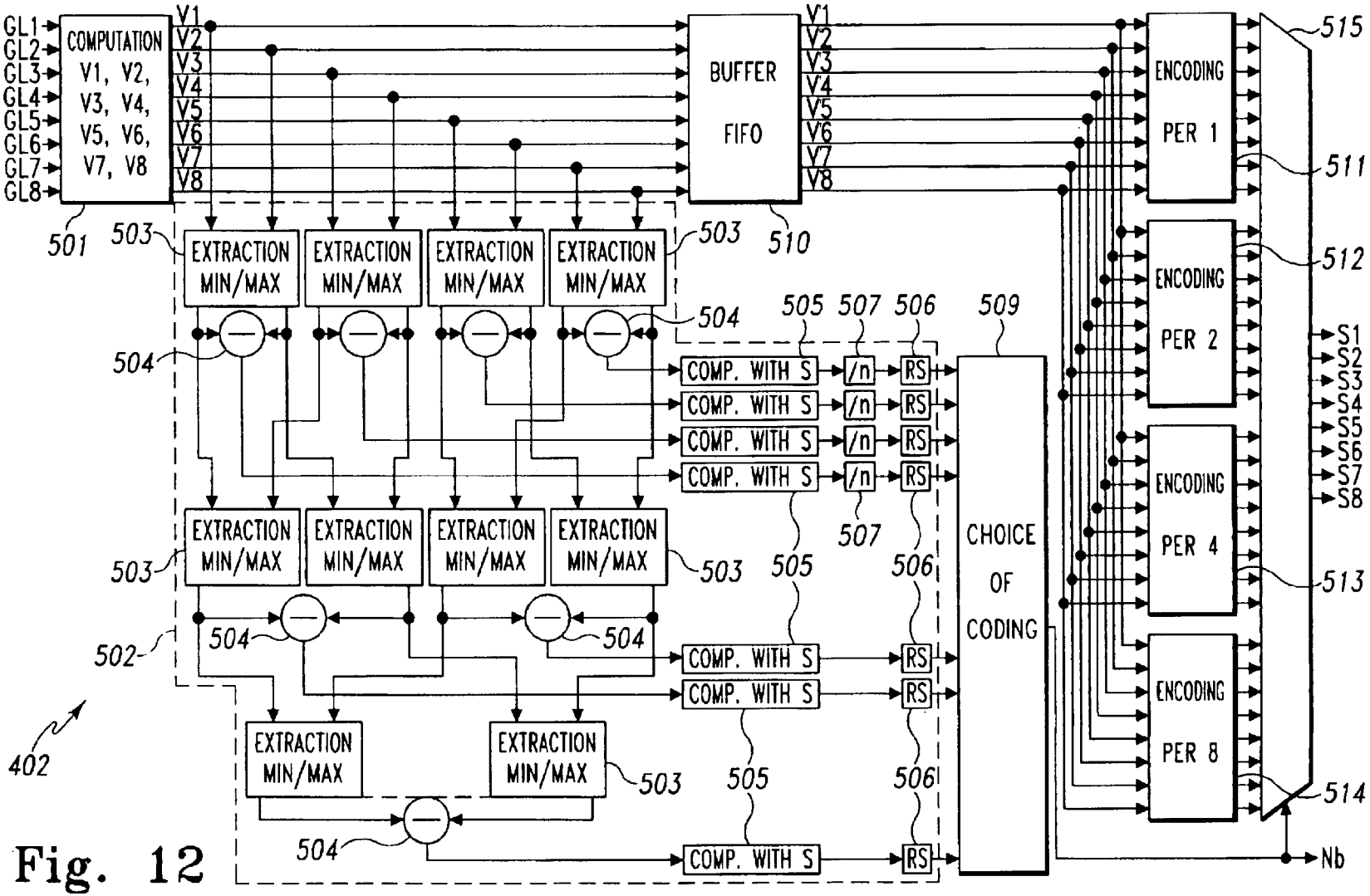

A first illustrative example of the circuit 402 for encoding over groupings of variable size is given in FIG. 12.

A computing circuit 501 receives the eight grey levels GL1 to GL8 in order to convert them into rounded values V1 to V8. The conversion is performed by computing the modulo-3, carried out for example using look-up tables, and then the most represented modulo-3 is determined, for example using comparators and counters, which becomes the rounded modulo. One is added to or subtracted from the grey levels which do not correspond to the most represented modulo-3 in order to obtain the rounded values V1 to V8.

By way of example, if the grey levels have values GL1=85, GL2=96, GL3=98, GL4=118, GL5=87, GL6=130, GL7=88 and GL8=91, then the following are obtained: mod 3 GL1=1, mod 3 GL2=0, mod 3 GL3=2, mod 3 GL4=1, mod 3 GL5=0, mod 3 GL6=1, mod 3 GL7=1 and mod 3 GL8=1. Since the most represented modulo-3 is the value 1, 1 is added to the grey levels associated with a modulo-3 equal to 0 and 1 is subtracted from the grey levels associated with a modulo-3 equal to 2. The following are then obtained: V1=85, V2=97, V3=97, V4=118, V5=88, V6=130, V7=88 and V8=91.

An evaluation circuit 502 extracts, from the eight values V1 to V8, the extrema in the various possible groupings and then computes the differences between the maximum and minimum for each group. The differences are then compared with a threshold and accumulated over the entire length of the row. In order to produce the various functions, a person skilled in the art may, for example, produce the circuit shown in FIG. 12 which includes extraction circuits 503, subtraction circuits 504, comparison circuits 505, accumulation switches 506 and possibly division circuits 507.

The extraction circuits 503 make use of two inputs and two outputs. One of the outputs delivers the maximum value of the two inputs and the other output delivers the minimum value of the two inputs. The extraction circuits 503 are cascaded so as to deliver a maximum value and a minimum value for each possible grouping, namely the pairs V1–V2, V3–V4, V5–V6 and V7–V8, the quartets V1 to V4 and V5 to V8 and the octet V1 to V8. The subtraction circuits 504 are placed so as to take the difference between the maximum and the minimum of each grouping and deliver the maximum difference of each grouping to the comparison circuits 505. The comparators 505 compare them with the threshold S and, for each grouping considered, indicate whether the maximum difference is greater than S. The accumulation switches 506 are, for example, bistable switches (RS-type switch), one of the inputs of which is connected to the output of the comparison circuits 505 and the other of the inputs of which (not shown) serves for resetting the switch at each start of row. The output of the accumulation switches makes it possible, on coming to the end of a row, to know if at least one error has been produced on the row.

Division circuits 507 may be placed between the comparison circuits 505 and the switches 506 if it is desired to permit errors. The division circuits 507 are, for example, possibly programmable counters, the carry-over output of which is connected to the accumulation switch 507. One counter per n has the effect of dividing the number of pulses received by the switch by n, this having the effect of indicating to the switch only the nth error. In our preferred example, the division circuits 507 are used only for the two-row groupings with n=3 so as to limit the defective points to the number of rows, thereby representing an error rate of less than 0.2%.

A selection circuit 509 is connected to the outputs of the accumulation switches 506 and determines, for example using combinatory logic circuits, what type of grouping can be used. In this illustrative example, the selection is made for the entire eight-row group. If no error occurs for the eight-row grouping, then a bit corresponding to encoding with simultaneous scanning of eight rows is activated. If at least one error occurs for the eight-row grouping and if no error occurs for the four-row groupings, then a bit corresponding to encoding with simultaneous scanning by four-row grouping is activated. If at least one error occurs for one of the four-row groupings and if at most two errors occur for the two-row groupings, then a bit corresponding to encoding with simultaneous scanning by two-row grouping is activated. If at least three errors occur for one of the two-row groupings, then a bit corresponding to encoding with individual scanning for each row is activated. The selection circuit 509 stores the four bits corresponding to the grouping selection and delivers them to an output bus, the four bits also corresponding to the information item Nb.

A buffer circuit 510 of the FIFO (First In First Out) type is placed at the output of the computing circuit 501 in order to delay the values V1 to V8. The delay thus introduced is equal to the time needed to evaluate the coding selection less the time needed for the coding. The buffer circuit 510 delivers, on its output, retarded values V'1 to V'8.

Four encoding circuits 511 to 514 are connected to the outputs of the buffer circuit 510. These four encoding circuits 511 to 514 operate in parallel in order to carry out the various possible codings. The first encoding circuit 511 codes row by row. The second encoding circuit 512 codes by two-row groups. The third encoding circuit 513 codes by four-row groups. The fourth encoding circuit 514 codes by eight-row groups. The encoding circuits are produced, for example, with the aid of look-up tables according to known techniques.

By way of example, the first encoding circuit 511 comprises eight look-up tables, each of which receives one of the retarded values V'1 to V'8. Each of the said tables delivers, on its output, the word corresponding to the subscans to be used to represent the said value. The other encoding circuits 512 to 514 decompose the retarded values V'1 to V'8 into a specific value and into a value common to the grouping made, and then encodes the common values on first look-up tables and the specific values on second look-up tables, the results then being combined in order to obtain the words corresponding to the subscans to be used to represent the values to be encoded.

A multiplexing circuit 515 selects, among the outputs of the encoding circuits 511 to 514, the outputs of just one of the said encoding circuits 511 to 514 according to the information item Nb. To make the selection, it is recommended that the output signals of the encoding circuits 511 to 514 be completely synchronous.

One limitation of this illustrative example lies in the fact that the eight-row groups are coded with identically sized groupings. Thus, if a high error rate is counted on a pair of rows, for example the pair corresponding to the grey levels GL1 and GL2, the eight rows are individually coded even if no error is observed on the pair corresponding to the levels GL3 and GL4 and if no error is observed on the quartet GL5 to GL8.

Figure 13:
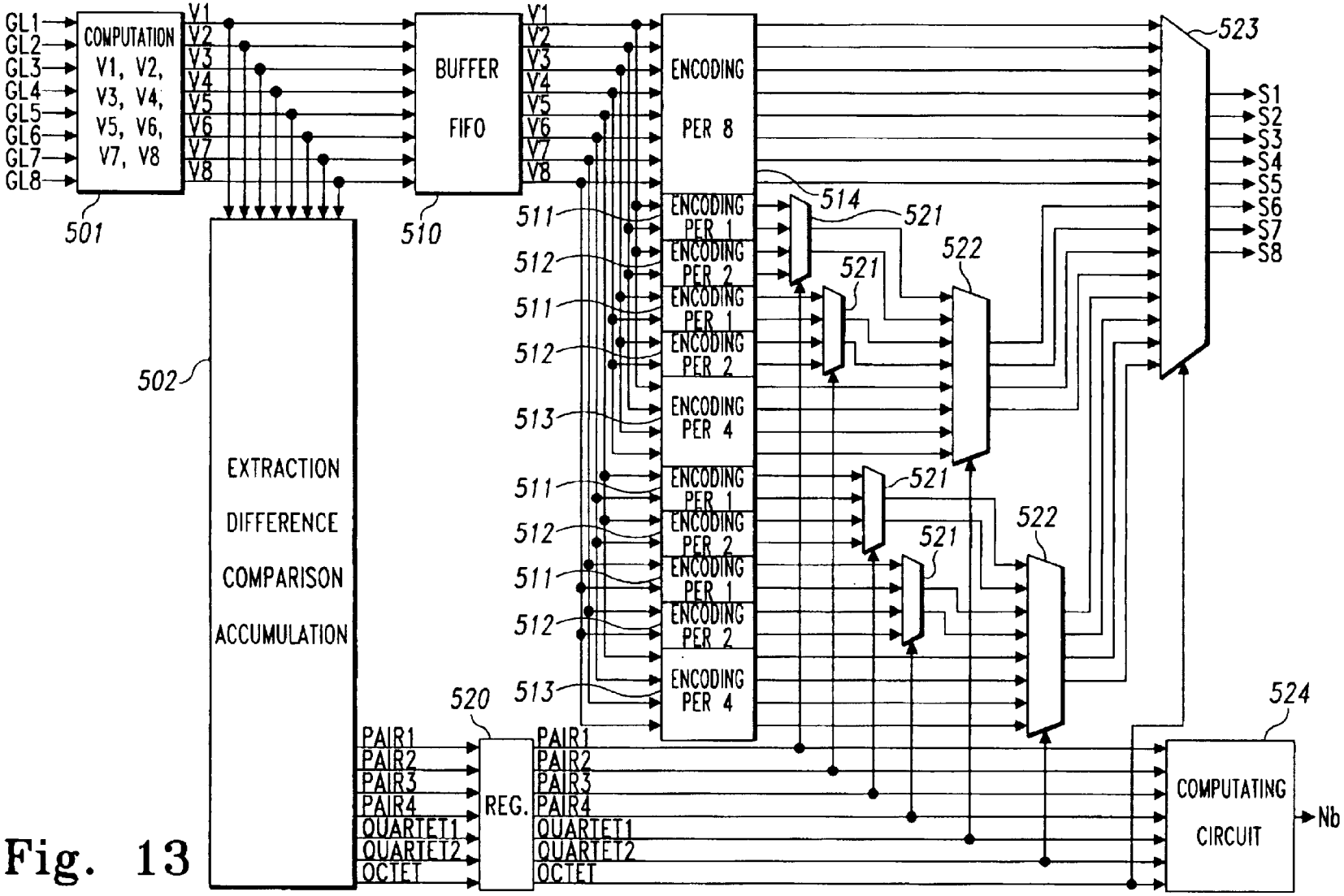

In order to make a more gradual selection of groupings, a second illustrative example of the circuit 402 for encoding over groupings of variable size is given in FIG. 13. The components bearing the same references as in FIG. 12 correspond to identical components. The encoding circuits 511 to 513 are broken down into functional components of smaller size for representational reasons. A person skilled in the art will readily understand that this break-down corresponds to a distribution of the resources of these encoding circuits without any fundamental modification.

The circuit in FIG. 13 differs from the circuit in FIG. 12 by the selection of the row groupings, which results in the omission of the selection circuit 509 and of the multiplexing circuit 515.

A register 520 is connected to the outputs of the evaluation circuit so as to store, at each end of row, the bits which indicate whether it is possible to encode the rows by pair, quartet or octet. The register 520 delivers, on its outputs, the signals stored throughout the duration of encoding a row.

First multiplexers 521 select the rows by pair as output by the first and second encoding circuits 511 and 512 according to the signals, coming from the register 520, which are associated with the pairs of rows. Thus, if a signal associated with one pair, for example the Pair1 signal associated with the grey levels GL1 and GL2, indicates that the number of errors is greater than two over the length of the row, then the multiplexer 521 corresponding to the pair selects that coding independent of the rows which is delivered by the first encoding circuit 511. If, on the other hand, a signal associated with a pair, for example the Pair2 signal associated with the grey levels GL3 and GL4, indicates that the number of errors is less than or equal to two over the length of the row, then the multiplexer 521 corresponding to the pair selects that coding by two-row group which is delivered by the second encoding circuit 512.

Second multiplexers 522 select the rows by four, on the one hand as output by the third encoding circuit 513 and on the other hand as output by the first multiplexers 521 according to the signals coming from the register 520 which are associated with the quartets. Thus, if a signal associated with a quartet, for example the Quartet1 signal associated with the grey levels GL1 to GL4, indicates that there is at least one error over the length of the row, then the multiplexer 522 corresponding to the quartet selects the coding coming from the first multiplexers 521. If, on the other hand, a signal associated with a quartet, for example the Quartet2 signal associated with the grey levels GL5 to GL8, indicates that there is no error over the length of the row, then the multiplexer 522 corresponding to the quartet selects the coding by four-row group coming from the third encoding circuit 513.

A third multiplexer 523 selects the rows by eight, on the one hand, as output by the fourth encoding circuit 514 and, on the other hand, as output by the second multiplexers 522 according to the signal coming from the register 520 which is associated with the octet. Thus, if a signal associated with the octet, for example the Octet signal associated with the grey levels GL1 to GL8, indicates that there is at least one error over the length of the row, then the multiplexer 523 selects the coding coming from the second multiplexers 522. If, on the other hand, a signal associated with the octet, for example the Octet signal associated with the grey levels GL1 to GL8, indicates that there is no error over the length of the line, then the multiplexer 523 selects the coding by eight-row group coming from the fourth encoding circuit 514.

With such a device, if the situation arises in which a high error density is located only on two rows among eight, for example the rows associated with the grey levels GL1 to GL2, then these two rows will be coded individually, the pair of rows of the same quartet, for example the pair associated with the grey levels GL3 and GL4, is coded with common subscans and the other rows, for example the quartet associated with the grey levels GL5 to GL8, are coded also using common subscans. The common subscans form here the subject of four addressings of a row group with a zero error rate.

The circuit 402 includes here a computing circuit 524 which receives the seven signals coming from the register 520 in order to convert them into a number of row groups Nb. The computing circuit 524 is produced, for example, using a combinatory logic circuit.

A person skilled in the art will understand that the invention is not limited to the examples described. Thus, the invention applies to row groups of larger size, for example 16 or 32 rows. Also, the invention applies to temporal scanning distributions other than that shown in FIG. 6 and whose sum of the weights of the subscans common to several rows may be different from 123.

In the description, it is permitted to have two errors per two-row grouping, but it is obvious that this number results from a compromise between the quality of the image and the ease of coding. A person skilled in the art will be able to permit any number of errors depending on the desired image quality. A person skilled in the art may also permit errors for four-row or eight-row groupings if he desires to benefit from a shorter address time to the detriment of image quality.

The description relates to a plasma display panel. The invention may be used for another type of display panel using elementary cells operating on an on/off basis using a matrix addressing system.

We claim:

1. A method for displaying a video image on a display device comprising a plurality of cells, in which each cell is illuminated for an illumination time by means of a plurality of subscans each having a specific duration associated with an illumination weight, wherein the subscans are distributed as first and second subscans, wherein the first subscans are addressed for each row of the panel and wherein the second subscans are addressed simultaneously at row groupings having a number of rows which varies according to the different grey levels of the pixels of the grouped rows of the image displayed.

2. The method according to claim 1, wherein, for all the rows, several possible ways of grouping the rows are evaluated and then the grouping which minimizes the display errors is chosen.

3. The method according to claim 1, wherein, for all the rows, several possible ways of grouping the rows are evaluated and then the possible grouping which has the most rows is chosen.

4. The method according to claim 1, wherein the groupings comprise one, two, four or eight rows.

5. The method according to claims 1, wherein the illumination weights associated with the first subscans are multiples of three.

6. A display device comprising a plurality of cells organized in rows and columns, each cell being illuminated over a display period for a time proportional to a grey level by means of a plurality of subscans, each subscan having an address time during which the rows are addressed in succession, wherein it includes means for addressing the rows by row grouping, the number of rows of which varies according to the different grey levels of the pixels of the grouped rows of the image to be displayed.

7. The device according to claim 6, wherein it includes evaluation means for evaluating several possible ways of grouping the rows.

8. The device according to claim 7, wherein it includes selection means for selecting the grouping which minimizes the display errors.

9. The device according to claim 6, wherein it includes selection means for selecting the possible grouping which has the most lines.

10. The device according to claim 6, wherein it includes a rounding circuit for rounding the grey levels addressed simultaneously so that the rounded levels have, between them, differences which are multiples of three.

11. The device according to claim 6, wherein the device is a plasma display panel and wherein the cells are discharge cells.

* * * * *